US009833828B2

(12) United States Patent
Ueda et al.

(10) Patent No.: US 9,833,828 B2
(45) Date of Patent: Dec. 5, 2017

(54) HOT-PRESS DEEP-DRAWING FORMING METHOD AND HOT-PRESS DEEP-DRAWING FORMING METHOD APPARATUS

(71) Applicant: FUJI JUKOGYO KABUSHIKI KAISHA, Tokyo (JP)

(72) Inventors: Takanori Ueda, Tokyo (JP); Tomoyuki Horimoto, Tokyo (JP); Shunsuke Izumi, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 213 days.

(21) Appl. No.: 14/643,671

(22) Filed: Mar. 10, 2015

(65) Prior Publication Data

US 2015/0266076 A1 Sep. 24, 2015

(30) Foreign Application Priority Data

Mar. 20, 2014 (JP) ..... 2014-057652

(51) Int. Cl.
*B21D 24/04* (2006.01)
*B21D 22/20* (2006.01)
(Continued)

(52) U.S. Cl.
CPC ..... *B21D 22/208* (2013.01); *B21D 22/22* (2013.01); *B21D 24/04* (2013.01); *B21D 37/16* (2013.01)

(58) Field of Classification Search
CPC ..... B21D 22/208; B21D 22/22; B21D 24/04; B21D 24/06; B21D 24/08; B21D 24/10;
(Continued)

(56) References Cited

U.S. PATENT DOCUMENTS 2,843,071 A * 7/1958 Kitzinger ..... B21D 22/26 220/DIG. 22
6,354,131 B1 * 3/2002 Pirchl ..... B21D 24/04 72/351
(Continued)

FOREIGN PATENT DOCUMENTS

DE 10318056 A1 * 11/2004 ..... B21J 5/00
EP 2548670 A1 * 1/2013 ..... B21D 22/02
(Continued)

OTHER PUBLICATIONS

Japanese Office Action dated Oct. 20, 2015 relative to Japanese patent application serial No. 2014-057652.

*Primary Examiner* — Edward Tolan
(74) *Attorney, Agent, or Firm* — Smith, Gambrell & Russell, LLP

(57) ABSTRACT

A hot-press deep-drawing forming apparatus includes a punch that constitutes a lower die and a die that constitutes an upper die. The punch has an inner-face forming surface that forms the inner face of a product, and a bent corner against which a scrap section S of a workpiece W abuts. The die has an outer-face forming surface that forms the outer surface of the product. A blank holder and a pre-forming die that clamp the scrap section are caused to move, together with the die, until the clamped scrap section abuts the bent corner. The movement of the blank holder and the pre-forming die is stopped after the scrap section has abutted the bent corner.

16 Claims, 10 Drawing Sheets

(51) Int. Cl.
*B21D 37/16* (2006.01)
*B21D 22/22* (2006.01)

(58) Field of Classification Search
CPC ..... B21D 24/12; B21D 24/14; B21D 24/16; B21D 37/16; C21D 1/673
See application file for complete search history.

(56) References Cited

U.S. PATENT DOCUMENTS

| | | | | |
|---|---|---|---|---|
| 8,261,591 | B2 * | 9/2012 | Hielscher | B21D 24/16 72/334 |
| 8,578,750 | B2 * | 11/2013 | Fang | B21D 24/16 72/294 |
| 2013/0205863 | A1 * | 8/2013 | Loesch | B21D 22/06 72/342.7 |

FOREIGN PATENT DOCUMENTS

| | | |
|---|---|---|
| JP | S58-77722 | 5/1983 |
| JP | 02-205210 | 8/1990 |
| JP | H03-66423 | 3/1991 |
| JP | 08-090094 | 4/1996 |
| JP | 2005-205416 | 8/2005 |
| JP | 2005-297042 | 10/2005 |
| JP | 2010-069535 | 4/2010 |
| JP | 2010-69535 | 4/2010 |
| JP | 2011-050972 | 3/2011 |

* cited by examiner

HOT-PRESS DEEP-DRAWING FORMING METHOD AND HOT-PRESS DEEP-DRAWING FORMING METHOD APPARATUS

CROSS-REFERENCE TO RELATED APPLICATIONS

The present application claims priority from Japanese Patent Application No. 2014-057652 filed on Mar. 20, 2014, the entire contents of which are hereby incorporated by reference.

BACKGROUND

1. Technical Field

The present invention relates to a hot-press deep-drawing forming technology that allows obtaining a high-strength product through deep-draw forming of a steel plate, in a state where the steel plate is heated at or above a transformation temperature, followed by die quenching of the formed steel plate.

2. Related Art

A steel plate, as a workpiece, is worked by draw-forming in order to form a product, having a three-dimensional shape through press-working of the steel plate. Products that are worked by forming include products that have: a main body having a U-shaped cross-sectional shape and made up of a front wall and side walls that are contiguous with the front wall; and a flange that is integral with the main body.

A press die for drawing a product having such a three-dimensional shape has: a die provided with a forming surface corresponding to the outer surface of the main body; a punch provided with a forming surface corresponding to the inner face of the product; and a blank holder that presses the edges of the workpiece, i.e. the steel plate, to suppress thereby the occurrence of wrinkles in the steel plate. Japanese Unexamined Patent Application Publication (JP-A) No. H2-205210 discloses a press die having a movable punch for intermediate drawing, and having upper and lower blank holders, wherein drawing of the central portion of the workpiece, and reverse-drawing of the outside of the workpiece, are performed through a single working operation of a press ram, JP-A No. H8-90094 discloses a drawn product forming apparatus in which a stepped drawn product is formed over one stroke. This apparatus has a lower die provided with a vertically movable blank holder, a punch that: can advance and retreat inward of the upper blank holder, and a vertically movable lower blank holder that clamps a thin plate together with the upper blank holder, JP-A No. 2011-50972 discloses a hot-press forming method. In this forming method, one stroke from forming start to forming termination is set to obey different forming conditions in initial-stage forming, middle-stage forming and final-stage forming, using a hot-press die that has a punch, a die and a die cushion, so that, as a result, wrinkles that occur halfway during forming are removed at the final-stage forming. JP-A No. 2010-69535 discloses a forming method that involves press quenching using a press apparatus having a lower forming tool, a vertically movable upper forming tool, and a blank holder, wherein a partially non-quenched region is formed at the edge region of a press-quenched steel plate.

JP-A No. 2005-297042 discloses a deep drawing method in hot forming. In this deep drawing method, a steel plate is heated at or below the melting point, and is formed at or above the transformation temperature, and the clearance between a blank holder surface and a die face is set to be equal to or smaller than the clearance of a gap, greater than, the thickness of the steel plate, and for which there occur wrinkles derived from contact of a same surface of the steel plate.

The above publications JP-A No. 2011-50972 and JP-A No. 2010-69535 both involve a method of flattening wrinkles at the final stage of forming, while allowing for the occurrence of wrinkles daring the forming process. However, there are parts difficult to form that give rise to problems such as excessive wrinkling during the forming process, with unacceptable wrinkles, or occurrence of wrinkles that cannot be fully flattened at the final stage of forming, with non-uniform contact between a die punch and a die. In cold working, by contrast, step drawing is performed in some instances in addition to that by a blank holder mechanism (for example, JP-A No. H2-205210). In hot press dies, however, there are sites where the workpiece continues to contact the die during the step drawing or the step performed by the blank holder mechanism. This may lead to unintended ongoing removal of heat from the workpiece, that gives rise to impaired ductility of the workpiece and to forming defects such as breakage in the formed product.

SUMMARY OF THE INVENTION

It is an object of the present invention to make it possible to work a hot-press deep drawing product, using a steel plate as a workpiece, and without occurrence of forming defects such as wrinkles and breakage, in difficult-to-form parts that cannot be formed in accordance with the methods in the above citations.

An aspect of the present invention provides a hot-press deep-drawing forming method of forming a product that has a main body of U-shaped cross-sectional shape provided with a front wall and a side wall, and a flange that is contiguous with the main body, through press-working of a workpiece made of a steel plate and heated at or above a transformation temperature, the method including: a pre-forming die movement step of causing a die, having a built-in cooling mechanism and provided with an outer-face forming surface that forms an outer surf ace of the product, as well as a blank, holder and a pre-forming die that clamp a scrap section of the workpiece, to relatively perform an approach movement towards a punch, having a built-in cooling mechanism and provided with an inner-face forming surface that, forms an inner face of the product, and with a bent corner against which the scrap section abuts, the approach movement being performed until the scrap section abuts the bent corner; and a final forming step of stopping the movement of the scrap section that is clamped by the blank holder and the pre-forming die, when the die moves towards the punch after the scrap section has abutted the bent corner.

Another aspect of the present invention provides a hot-press deep-drawing forming apparatus for forming a product that has a main body of U-shaped cross-sectional shape provided with a front wall and a side wall, and a flange that is contiguous with, the main body, through press-working of a workpiece made of a steel plate and heated at or above a transformation temperature, the apparatus including: a punch, having a built-in cooling mechanism, and provided with an inner-face forming surface that forms an inner face of the product, and with a bent, corner against which a scrap section of the workpiece abuts; a die, having a built-in cooling mechanism, provided with an outer-face forming surface that forms an outer surface of the product, and performing an approach-separation movement relatively to the punch; a blank holder against which the scrap section abuts; a pre-forming die that clamps the scrap section together with the blank holder; and a double action mechanism that causes the blank holder and the pre-forming die to move, together with the die, until the scrap section clamped by the blank holder and the pre-forming die abuts the bent corner, and that stops the movement of the blank holder and of the pre-forming die when the die approaches the punch after the scrap section has abutted the bent corner.

DETAILED DESCRIPTION

Figure 1A:
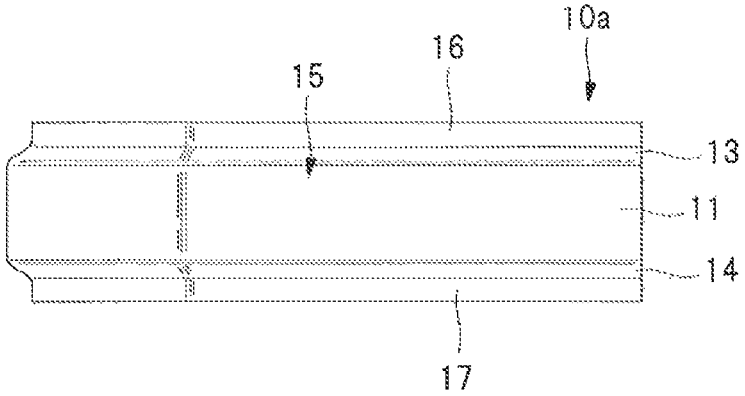
FIG. 1A is a front-view diagram illustrating an example of a product that, is formed by deep-draw forming.

Implementations of the present invention will be explained next in detail with reference to accompanying drawings. A product 10*a* illustrated in FIG. 1 has a main body 15 provided with a front wall 11 that extends in a longitudinal direction and with side walls 13, 14 that are contiguous with the front wall 11, on both sides in the width direction of the front wall 11, by way of respective arc-shaped bends 12, as illustrated in FIGS, 1A and 1B. The width dimensions of both side walls 13, 14 are substantially identical. The reverse side of the main body 15 with respect to front wall 11 constitutes an opening end, with the side walls 13, 14 being slightly tilted outwards facing the opening end. The width dimension of the opening end is slightly larger than the width dimension of the front wall 11, and the transversal cross-sectional shape of the main body 15 is U-shaped. The flanges 16, 17, that are integral with the main body 15, are contiguous with the side walls 13, 14 by way of respective arc-shaped bends 18, and are parallel to the front wall 11. Further, the product 10*a* does not extend completely straight in the longitudinal direction but is bent, at a portion of a bend 19, to an overall dogleg shape as illustrated in FIG. 1C.

Figure 1B:
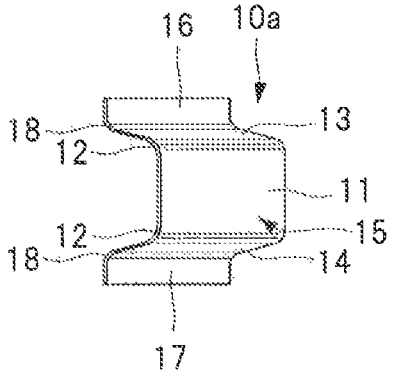
FIG. 1B is a left side-view diagram of FIG. 1A.
Figure 1C:
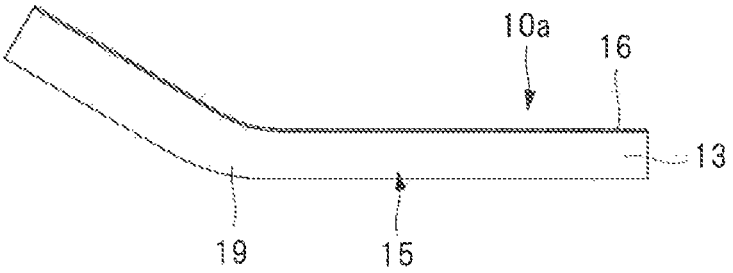
FIG. 1C is a plan-view diagram of FIG. 1A.
Figure 2A:
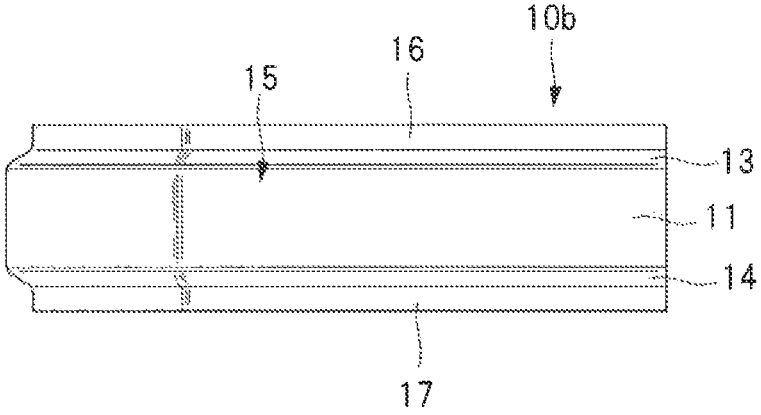
FIG. 2A is a front-view diagram illustrating another example of a product.
Figure 2B:
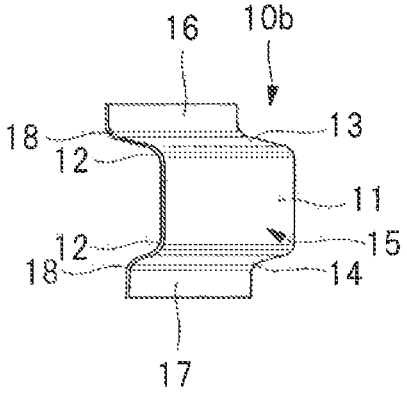
FIG. 2B is a left side-view diagram of FIG. 2A.
Figure 2C:
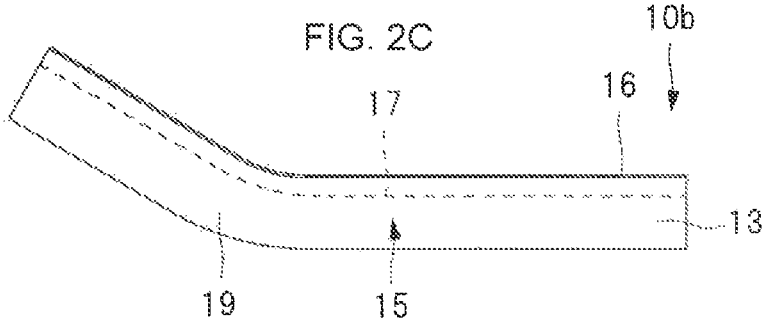
FIG. 2C is a plan-view diagram of FIG. 2A.

The entire shape of a product 10*b* illustrated in FIG. 2 is substantially identical to that of the product 10*a* illustrated in FIG. 1. The product 10*b* differs from the product 10*a* in that herein the width dimension of the side wall 13 is larger than the width dimension of the side wall 14.

Figure 3A:
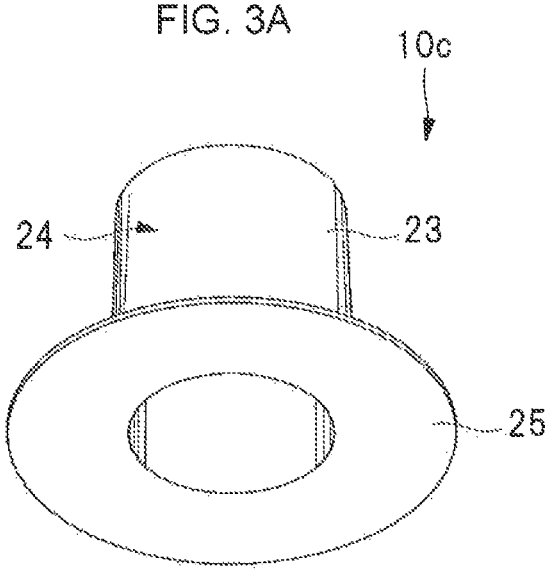
FIG. 3A is a perspective-view diagram illustrating yet another example of a product.
Figure 3B:
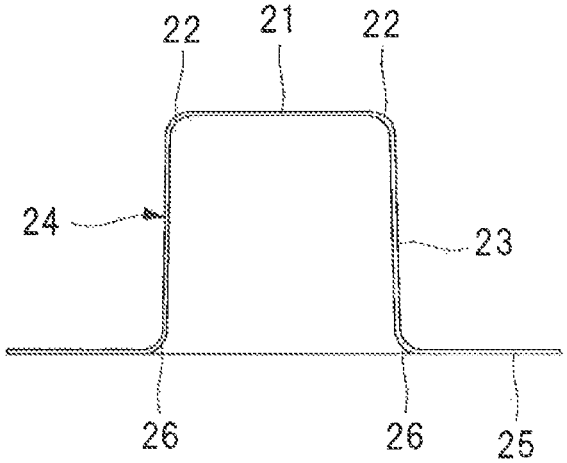
FIG. 3B is a longitudinal cross-sectional diagram of FIG. 3A.

A product 10*c* illustrated in FIG. 3 has a main body 24 that is provided with a circular front wall 21, and a cylindrical side wall 23 that is contiguous with the outer periphery of the front wall 21 via a bend 22. The reverse side of the main body 24 with respect to the front wall 21 constitutes an opening end. The cylindrical side wall 23 is slightly tilted outwards facing the opening end. A flange 25 is integral with the main body 24. The flange 25 is contiguous with the side wall 23, by way of an arc-shaped bead 26, and is parallel to the front wall 21.

In the products 10*a* to 10*c* above, a steel plate as a workpiece undergoes plastic working to a three-dimensional shape, by hot-press deep drawing work, and is then quenched i.e. subjected to a quenching process.

FIG. 4 to FIG. 7 are cross-sectional diagrams illustrating a hot-press deep-drawing forming apparatus 30 for forming the product 10*a* illustrated in FIG. 1, through deep drawing of a workpiece W. The workpiece W that is worked to the product 10*a* has a cuboid shape and includes a product section T that encompasses the main body 15 and the side walls 13, 14, and a scrap section S that is contiguous with the outside of the product section T. The workpiece W made of a steel plate is heated beforehand at the austenitizing transformation temperature, and is conveyed to the forming apparatus 30 illustrated in the figure.

The forming apparatus 30 has a lower die 31 made up of a punch. The lower die 31 has an inner-face forming surface 32 that forms the inner face of the product 10*a*, The inner-face forming surface 32 has an inner-face forming surface 32*a* that forms the inner face of the thee front wall 11, inner-face forming surfaces 32*b* that form the inner faces of the bends 12, and inner-face forming surfaces 32*c* that form the inner faces of the side walls 13, 14, and further has inner-face forming surfaces 32*d* that form the inner faces of the bends 18, and inner-face forming surfaces 32*e* that forms the inner faces of the flanges 16, 17. The scrap section S of the work piece W abuts against bent corners 33 that are provided on both sides of the lower die 31. The cross-sectional shape of the bent corners 33 is arcuate, such that the ends of the bent corners 33 are contiguous with respective lower die side faces 34 that extend in the vertical direction, A base 35 is provided at the lower end of the lower die 31. The lower die 31 is fixed to a bolster, i.e. a platform, not shown in the figures, of the base 35.

A cooling system 36 through which a cooling medium circulates is built into the lower die 31, for the purpose of quenching the workpiece W, by cooling, once press-working of the workpiece W is over. A coolant, as a cooling medium, is supplied into the cooling system 36 by a pump, not shown, such that the lower die 31 is cooled down to a predetermined quench temperature by the cooling mechanism that is configured by the cooling system 36.

The forming apparatus 30 has an upper die 41 made up of a die. The upper die 41 is disposed above the lower die 31 that is made up of a punch, and can move so as to come close to and draw apart from the lower die 31, i.e. is vertically movable. The upper die 41 has an outer-face forming surface 42 that forms the outer surface of the product 10*a*. The outer-face forming surface 42 has an outer-face forming surface 42*a* that forms the outer surface of the front wall 11, outer-face forming surfaces 42*b* that form the outer surfaces of the bends 12, and outer-face forming surfaces 42*c* that form the outer surfaces of the side walls 13, 14, and further has outer-face forming surfaces 42*d* that form, the outer surfaces of the bends 18, and outer-face forming surfaces 42*e* that form the outer surface the flanges 16, 17. The outer-face forming surfaces 42*e* are contiguous with upper die side faces 44 that extend in the vertical direction. A base 45 is provided at the upper end of the upper die 41, such that the upper die 41 is attached to a vertical movement mechanism, not shown, at a portion of the base 45.

A cooling system 46 through which a cooling medium circulates is built into the upper die 41, for the purpose of quenching the workpiece W, by cooling, once press-working of the workpiece W is over. A coolant, as a cooling medium, is supplied into the cooling system 46 by a pump, not shown, such that the upper die 41 is cooled down to a predetermined quench temperature by the cooling mechanism that is configured by the cooling system 46.

Blank holders 51 that abut the scrap section S of the workpiece W are disposed at the base 35 of the lower die 31, on both sloes of the lower die 31. The blank holders 51 are mounted on the lower die by holder driving members 52 that run through the base 35. Bottoming blocks 53 that abut the bottom faces of the blank holders 51 are attached to the base 35, in order to restrict the descent position of the blank holders 51. The bottoming blocks 53 may be attached to the bottom faces of the blank holders 51.

Pre-forming dies 61 are provided above the blank holders 51 such that the scrap section S of the workpiece W is clamped between the blank holders 51 and the pre-forming dies 61. The pre-forming dies 61 are mounted on the base 45 or the upper die 41 by way of elastic members 62, for instance rubber, coil springs or the like. By virtue of the elastic force of the elastic members 62, the scrap section S is brought to state of being pinched between the blank holders 51 and the pre-forming dies 61, i.e. a clamped state. Clearance blocks 63 are attached to the bottom faces of the pre-forming dies 61, in order to provide a clearance corresponding to the thickness of the scrap section S between the pre-forming dies 61 and the blank holders 51. The clearance blocks 63 may be attached to the top faces of the blank holders 51. A corner 64 is formed at the bottom of each pre-forming die 61 at a portion facing the upper die 41.

The holder driving members 52 constitute a movable pressure source that exerts a clamping force on the scrap section S. The elastic members 62 constitute a pressure source that exerts a clamping force on the scrap section S, via the pre-forming dies 61. A double action mechanism 65 is configured by the holder driving members 52, the bottoming blocks 53 and the elastic members 62. The double action mechanism 65 clamps the scrap section S between the blank holders 51 and the pre-forming dies 61, during deep-draw forming at an early stage of work in which the upper die 41 is caused to approach the lower die 31, and then brings both the blank holders 51 and the pre-forming dies 61 closer to the lower die 31, until the scrap section S abuts the bent corners 33 of the lower die 31. The occurrence of wrinkles in the workpiece W at the time of deep drawing work is suppressed thanks to this approach movement. As a result of the approach movement of the pre-forming dies 61 towards the lower die 31, the blank holders 51 abut the bottoming blocks 53 when the scrap section S abuts the bent corners 33. The descent of the blank holders 51 and the pre-forming dies 61, i.e. the approach movement thereof towards the lower die 31, is arrested thereby, and the movement stops.

In a state where the movement of the blank holders 51 and the pre-forming dies 61 has stopped, the upper die 41 moves then closer to the lower die 31, whereupon a portion of the product 10*a* becomes formed by the lower die 31 and the upper die 41, without the scrap section S coming into contact with the bent corners 33 or the lower die side faces 34 of the lower die 31. The elastic members 62 contract in response to the movement of the upper die 41, since the movement of the blank holders 51 and the pre-forming dies 61 at this time is stopped. With the blank holders 51 in a stopped state, heat is not transmitted from the scrap section S to the lower die 31 and so forth, and excessive heat removal is thus prevented.

In the hot-press deep drawing work by the forming apparatus 30, thus, the blank holders 51 and the pre-forming dies 61 function as blank holders upon a predetermined initial forming stroke, such that heat removal of the workpiece W is suppressed after the blank: holder fraction is stopped. As a result, it becomes possible to form the workpiece W to the product 10*a* of predetermined shape, without occurrence of forming defects, upon hot-press deep drawing work of a steel plate, as the workpiece, to a three-dimensional shape such as the one illustrated in FIG. 1.

An explanation follows next, with reference to FIG. 4 to FIG. 7, on a forming method that involves deep-draw forming of the workpiece W using the forming apparatus 30.

Figure 4:
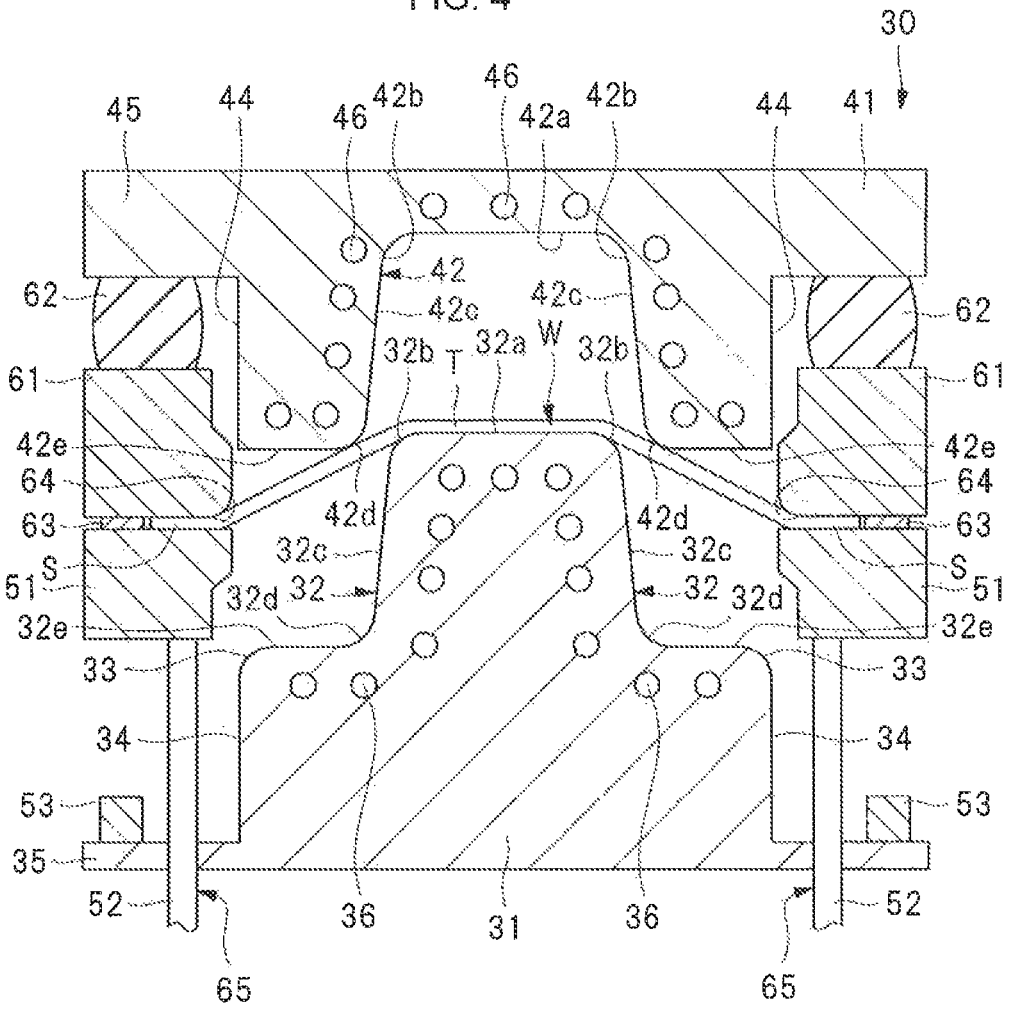
FIG. 4 is a cross-sectional diagram illustrating an initial stage of forming in a hot-press deep-drawing forming apparatus in an implementation.

The workpiece W, in a state of having been heated beforehand at or above the transformation temperature, is conveyed onto the lower die 31. At this time, the upper die 41 is at an upper-limit position retracted from the lower die 31. In this state, the upper die 41 is driven and is brought thereby closer to the lower die 31, whereupon the scrap section S of the workpiece W becomes clamped by the blank holders 51 and the pre-forming dies 61. FIG. 4 illustrates a forming initial stage wherein as a result of the movement of the upper die 41 and the pre-forming dies 61, the scrap section S of the workpiece W is clamped by the blank holders 51 and the pre-forming dies 61, whereby the scrap section S is folded downward, of the inner-face forming surface 32*a* of the lower die 31, and the outer-face forming surfaces 42*d* of the upper die 41 abut the workpiece W.

Figure 5:
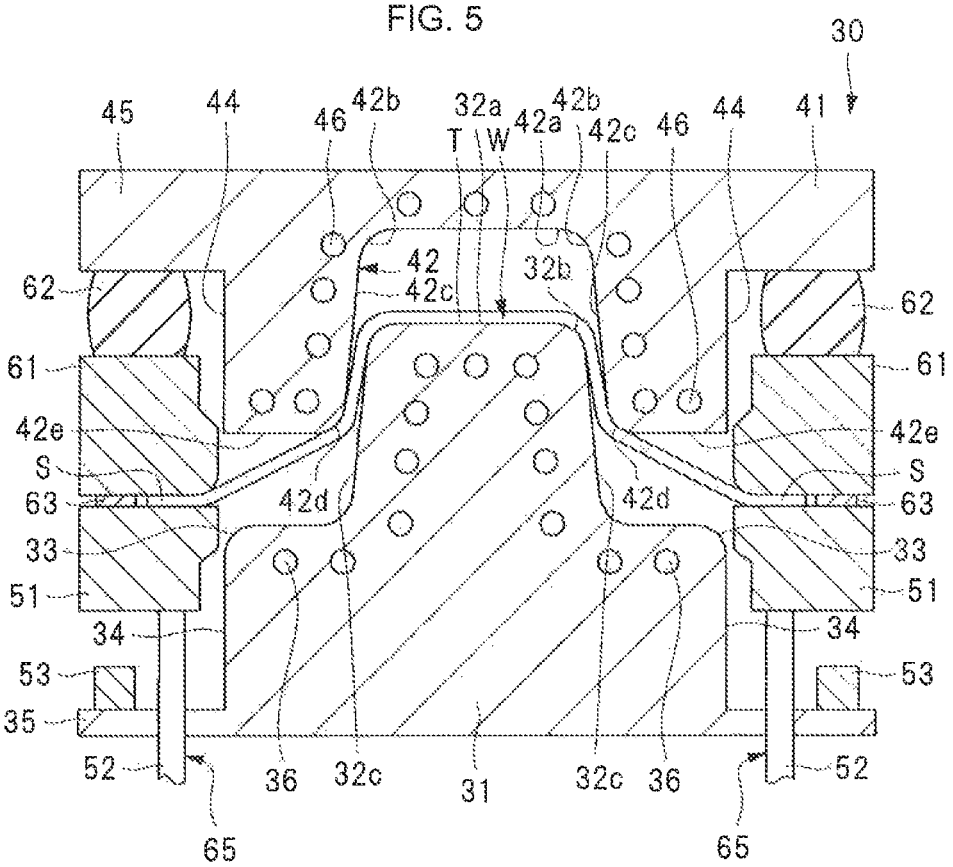
FIG. 5 is a cross-sectional diagram illustrating the hot-press deep-drawing forming apparatus of FIG. 4 in a state where forming has progressed from that in FIG. 4.

When the upper die 41 approaches the lower die 31, i.e. descends, the outer-face forming surfaces 42*d* of the upper die 41 abut the workpiece W, whereby the side walls 13, 14 become formed accompanying this descent, as illustrated in FIG. 5. At this time, the blank holders 51 and the pre-forming dies 61 as well descend together with the upper die 41.

Figure 6:
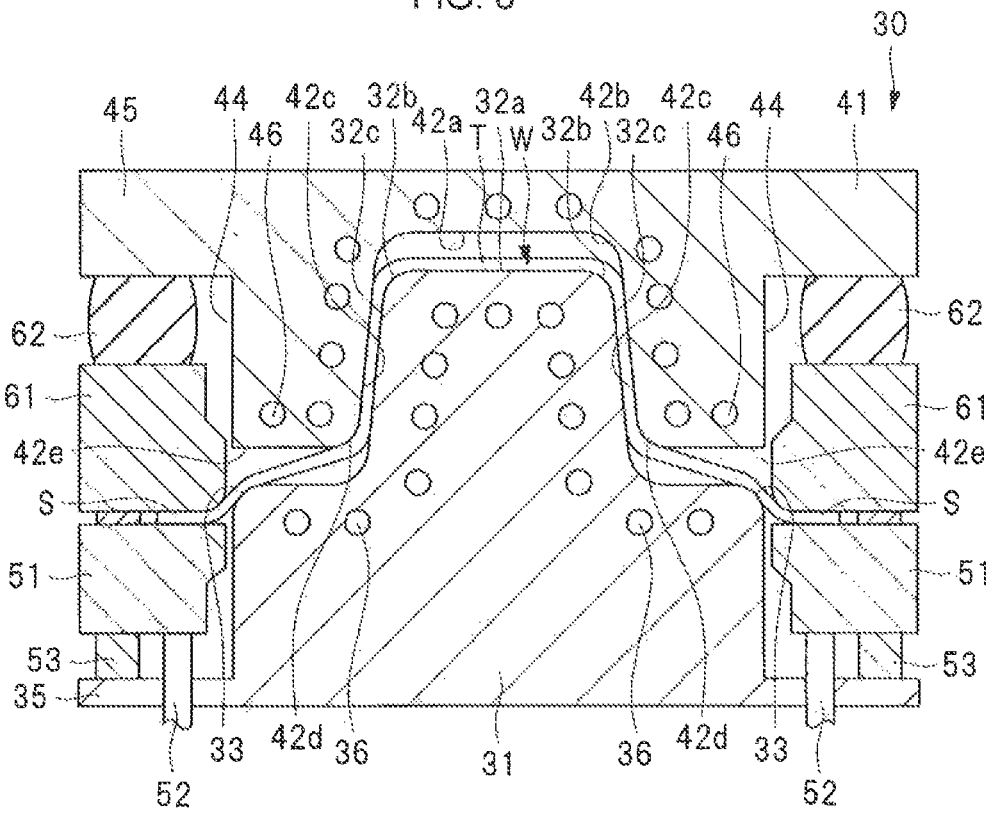
FIG. 6 is a cross-sectional diagram illustrating the hot-press deep-drawing forming apparatus of FIG. 4 in a state where a pre-forming die movement process is over.

FIG. 6 illustrates a state wherein the scrap section S abuts the bent corners 33 of the lower die 31 as a result of the descent of the upper die 41 together with the blank holders 51 and the pre-forming dies 61. At this time, the blank holders 51 abut the bottoming blocks 53, as illustrated in FIG. 6, and the descent of the blank holders 51 and the pre-forming dies 61 is stopped. The process of descent of the upper die 41 until the stop of the descent of the blank holders 51 and the pre-forming dies 61 constitutes a pre-forming die movement process. In this pre-forming die movement process the scrap section S is clamped, and hence occurrence of wrinkles in the workpiece W is suppressed. In a state where the scrap section S abuts the bent corners 33 of the lower die 31 only a small portion of the scrap section S comes in contact with the lower die 31, since the bent corners 33 have an arcuate cross-sectional shape.

The process where the upper die 41 approaches the lower die 31 down to a descent limit position, from a state in which one scrap section S abuts the bent corners 33 and the descent of the blank holders 51 and the pre-forming dies 61 is stopped, constitutes herein a final forming process. In this final forming process, the movement of the scrap section S that is clamped by the blank holders 51 and the pre-forming dies 61 in a stopped state is discontinued, such that, when the upper die 41 moves down to the descent limit position, the product 10*a* having the flanges 16, 17 and the main body 15 made up of the front wall 11 and the side walls 13, 14 undergoes deep drawing work by the product section T of the workpiece W, as illustrated in FIG. 7.

In the final forming process, the outer-face forming surfaces 42*d* of the upper die 41 abut the outer surface of the workpiece W, and move towards the lower die 31. Hence, the inner-face forming surfaces 32*c* of the lower die 31 and the outer-face forming surfaces 42*c* of the upper die 41 move gradually so as to come closer to a portion, in the product 10*a*, that corresponds to the side walls 13, 14. The final forming process is over when the flanges 16, 17 of the product 10*a* are clamped between the inner-face forming surfaces 32*e* of the lower die 31 and the outer-face forming surfaces 42*e* of the upper die 41. At this point in time, the entirety of the product section T in the workpiece W is in contact with the inner-face forming surface 32 of the lower die 31 and the outer-face forming surface 42 of the upper die 41. The product section T is then quenched by undergoing a heat removal treatment.

Figure 7:
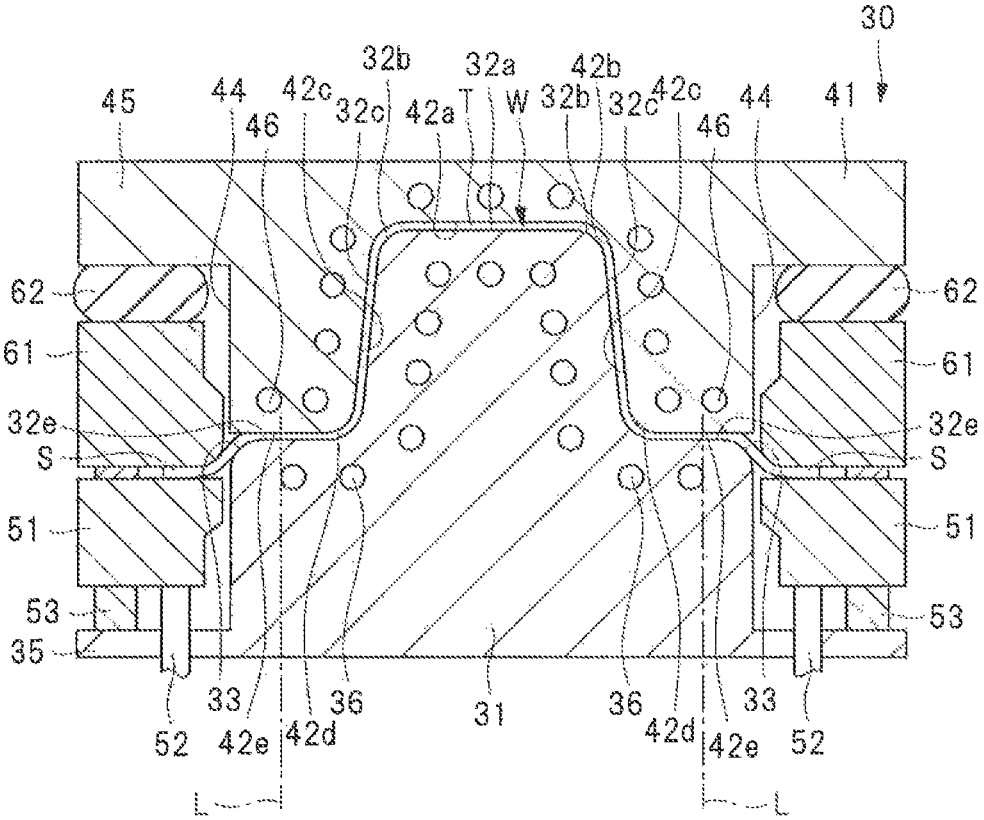
FIG. 7 is a cross-sectional diagram illustrating the hot-press deep-drawing forming apparatus of FIG. 4 in a state where a final forming process is over.

In the final forming process, as illustrated in FIG. 7, only part of the scrap section S is in contact with the bent corners 33, in that the scrap section S wraps around the bent corners 33 of the lower die without coming in contact with the lower die side faces 34. Therefore, the final forming process is performed in a state of enhanced formability, without excessive removal of heat from the workpiece W. The product 10*a* after forming is then subjected to quenching while in contact with the lower die 31 and the upper die 41. The product. 10*a* having a three-dimensional shape such its the one illustrated in FIG. 1 can be formed as a result with good yield and free of forming defects. The scrap section S of the workpiece W after quenching is cut off at a portion of a boundary L between the scrap section S arid the product section T. The product 10*a* of three-dimensional shape illustrated in FIG. 1 is thus worked as the product section T. The product 10*b* illustrated in FIG. 2 and the product 10*c* illustrated in FIG. 3 are worked similarly.

In the forming apparatus 30 illustrated in FIG. 4 to FIG. 7, both the blank holders 51 and the pre-forming dies 61 are brought closer to the lower die 31 until the scrap section S abuts the bent corners 33 of the lower die 31, and in the final forming process, the double action mechanism 65 for stopping the blank holders 51 and the pre-forming dies 61 is configured by the holder driving members 52, the bottoming blocks 53 and the elastic members 62.

The pre-forming dies 61 need not necessarily be provided in the upper die 41 via the elastic members 62; alternatively, the ore-forming dies 61 may be attached to respective slide dies that are provided on the upper die 41 side, so that, as a result, the pre-forming dies 61 may similarly undergo a double action.

Figure 8:
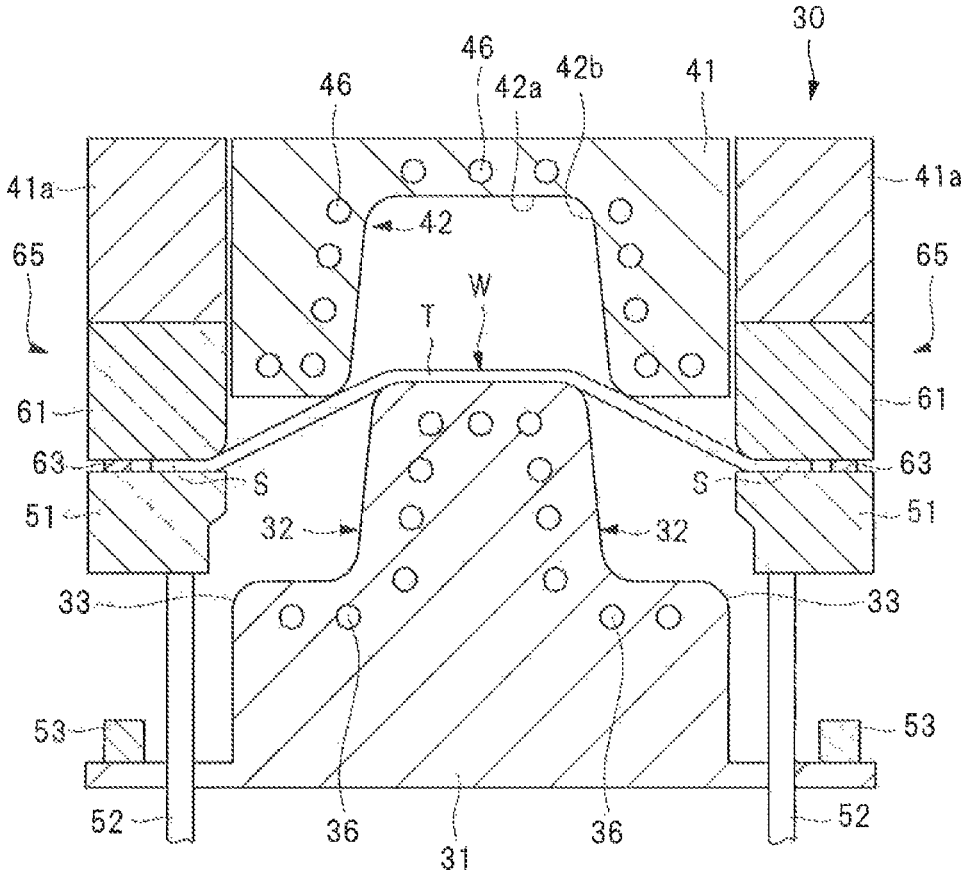
FIG. 8 is a cross-sectional diagram illustrating an initial stage of forming in a hot-press deep-drawing forming apparatus in another implementation.
Figure 9:
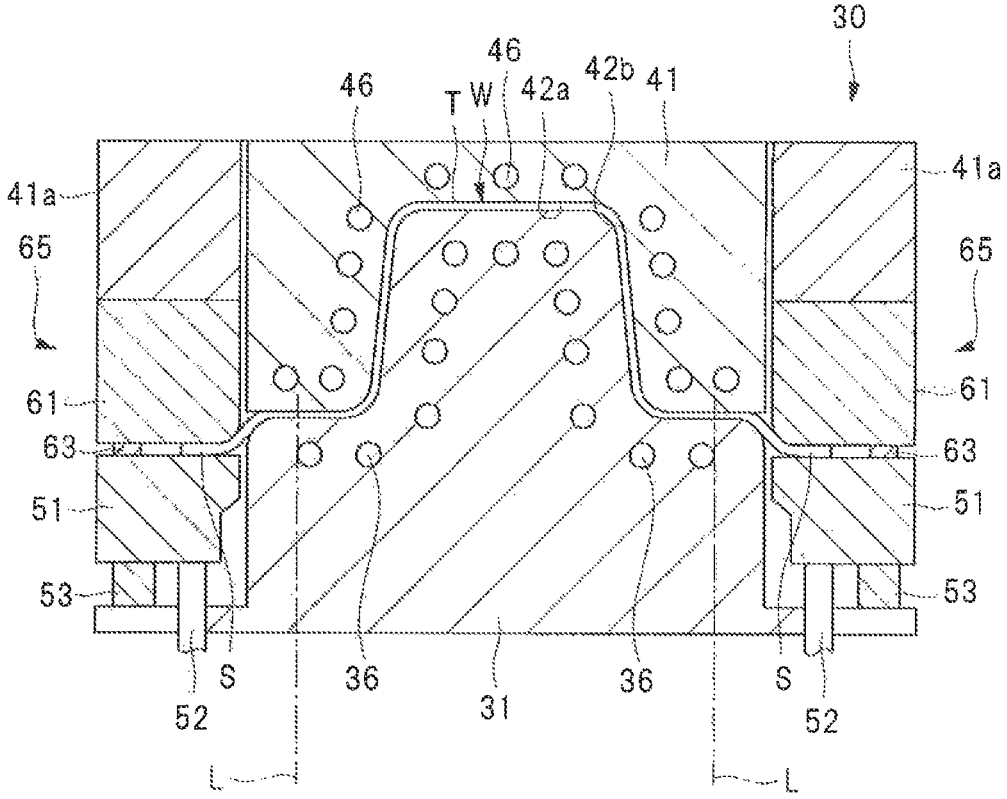
FIG. 9 is a cross-sectional diagram illustrating the hot-press deep-drawing forming apparatus of FIG. 8 in a state where a final forming process is over.

FIG. 8 and FIG. 9 illustrate a variation of the forming apparatus 30 in which the pre-forming dies 61 are caused, to move vertically, in synchrony with the blank holders 51, by a forming die driving member, i.e. a vertical movement mechanism. In FIG. 8 and FIG. 9, those members shared with the members that make up the forming apparatus 30 described above will be denoted by identical reference symbols.

FIG. 8 illustrates a state, corresponding to FIG. 4, in which the pre-forming dies 61 have descended, by a predetermined distance, together with the upper die 41. FIG. 9 illustrates a state where the final forming process is over, with the upper die 41 closest to the lower die 31. As illustrated in FIG. 8 and FIG. 9, slide dies 41*a* are mounted on the upper die 41 so as to be vertically movable. The forming apparatus 30 has a double action press structure. The pre-forming dies 61 are attached to the slide dies 41*a*. Except for the pre-forming dies 61 being attached to the slide dies 41*a*, other features are identical to those of the forming apparatus 30 described above.

In this forming apparatus 30, the scrap section S of the workpiece W is clamped, by the blank holders 51 and the pre-forming dies 61; the pre-forming dies 61 are thereafter caused to descend, by the slide dies 41*a*, towards the lower die 31, in synchrony with the blank holders 51.

The descent of the pre-forming dies 61 is stopped by the slide dies 41*a* after the scrap section S abuts the bent corners 33. The descent of the blank holders 51 as well is stopped at this time by the holder driving members 52. A double action operation on the pre-forming dies 61 may be performed thus by resorting to the slide dies 41*a*.

Figure 10:
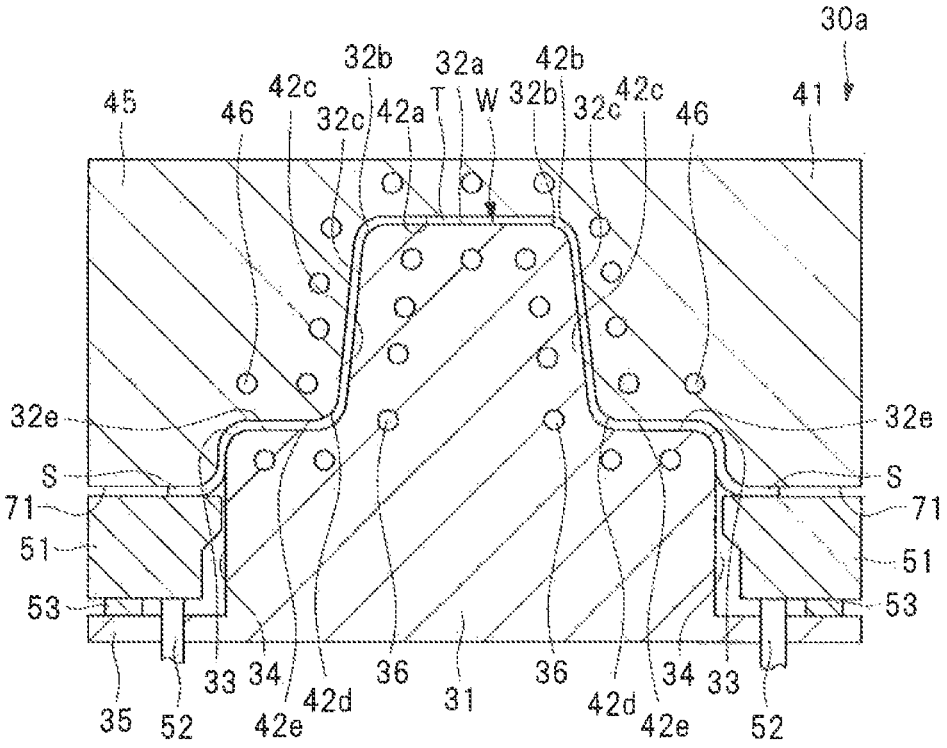
FIG. 10 is a cross-sectional diagram depicting a hot-press deep-drawing forming apparatus that is illustrated as a comparative example.

FIG. 10 is a cross-sectional diagram illustrating a hot-press deep-drawing forming apparatus 30*a* as a comparative example. In this comparative example, the scrap section S is clamped between the blank holders 51 and clamping surfaces 71 that are provided on the upper die 41; formation of the scrap section S proceeds thereupon until the upper die 41 moves down to the descent limit position. Accordingly, the scrap section S is brought to a state of being pressed against the bent corners 33 and the lower die side faces 34, as illustrated in FIG. 10, and hence the lower die 31 removes heat from, the workpiece W before the final forming process. Concerns arise as a result, in the forming apparatus 30*a* illustrated, in FIG. 10, of forming defects such as wrinkles or breakage in the formed product, and reduced forming yield.

In the various forming apparatuses 30 described above, the lower die 31 constitutes a punch that forms the inner face of the product, and the upper die 41 constitutes a die that forms the outer surface of the product. Alternatively, hot-press deep drawing work can be similarly performed on a product having a three-dimensional shape, with good yield and while suppressing the occurrence of wrinkles, using the upper die as the punch and the lower die as the die.

The present invention is not limited to the above implementations, and may accommodate various modifications without departing from the gist of the invention. Products that can be worked using the forming apparatus 30 are not limited to those illustrated in FIG. 1 to FIG. 3, and products of various shapes can undergo deep drawing work if the products involve a significant degree of drawing. In the forming apparatus 30 illustrated in the figures, the punch is the lower die 31 and the die is the upper die 41, but the top-bottom configuration may be reversed, and the upper die may serve as the punch and the lower die may serve as the die. Further, the punch may be caused to move vertically, instead of the die moving vertically. Also, both the die and the punch may be set to move vertically, so long as a relative approach-separation movement relationship between the die and the punch is obeyed.

The invention claimed is:

1. A hot-press deep-drawing forming method of forming a product that has a main body of U-shaped cross-sectional shape provided with a front wall and a side wall, and a flange that is contiguous with the main body, through press-working of a workpiece made of a steel plate and heated at or above a transformation temperature, the method comprising:

a pre-forming die movement step of causing a die, having a built-in cooling mechanism and provided with an outer-face forming surface that forms an outer surface of the product, as well as a blank holder and a pre-forming die that clamp a scrap section of the workpiece, to relatively perform an approach movement towards a punch, having a built-in cooling mechanism and provided with an inner-face forming surface that forms an inner face of the product, and with a bent corner against which the scrap section abuts, the approach movement being performed until the scrap section contacts with the bent corner; and a final forming step of stopping the movement of the scrap section that is clamped by the blank holder and the pre-forming die, while the die moves towards the punch after the scrap section has contacted with the bent corner.

2. The hot-press deep-drawing forming method according to claim 1, wherein the punch is a lower die, the die is an upper die that is vertically movable towards the punch, the pre-forming die is mounted on the upper die via an elastic member, the blank holder is mounted on the lower die by a holder driving member, and while the die moves towards the punch after the scrap section has contacted with the bent corner, the elastic member is caused to contract and the movement of the pre-forming die is stopped.

3. The hot-press deep-drawing forming method according to claim 1, wherein the punch is a lower die, the die is an upper die that is vertically movable towards the punch, the pre-forming die is mounted on a slide die that is mounted on the die so as to be vertically movable, the blank holder is mounted on the punch by a holder driving member, and while the die moves towards the punch after the scrap section has contacted with the bent corner, the movement of the pre-forming die is stopped by the slide die.

4. The method of claim 1 wherein the bent corner is an arcuate bent corner in cross-section.

5. The method of claim 1 further comprising separation of the scrap section from a remainder of the workpiece following completion of the die moving towards the punch after the scrap section has contacted with the bent corner.

6. The method of claim 5 wherein the separation is carried out by a cutting operation.

7. The method of claim 1 wherein there is avoided heat dissipation at the scrap section by having a spacing gap formed between exterior siding of the die and punch combination and interior siding of the pre-forming die and the blank holder in a region where the scrap section bridges the spacing gap.

8. The method of claim 1 wherein the forming includes having the scrap section extend so as to be sandwiched between the die and the punch combination.

9. The method of claim 1 further comprising applying a heat removal treatment to a product section of the work piece with the punch and the die without applying a heat removal treatment to the scrap section.

10. A hot-press deep-drawing forming apparatus for forming a product that has a main body of U-shaped cross-sectional shape provided with a front wall and a side wall, and a flange that is contiguous with the main body, through press-working of a workpiece made of a steel plate and heated at or above a transformation temperature, the apparatus comprising:

a punch, having a built-in cooling mechanism and provided with an inner-face forming surface that forms an inner face of the product, and with a bent corner against which a scrap section of the workpiece abuts;

a die, having a built-in cooling mechanism, provided with an outer-face forming surface that forms an outer surface of the product, and performing an approach-separation movement relatively to the punch;

a blank holder against which the scrap section abuts;

a pre-forming die that clamps the scrap section together with the blank holder; and a double action mechanism that causes the blank holder and the pre-forming die to move, together with the die, until the scrap section clamped by the blank holder and the pre-forming die contacts with the bent corner, and that stops the movement of the blank holder and of the pre-forming die while the die approaches the punch after the scrap section has contacted with the bent corner.

11. The hot-press deep-drawing forming apparatus according to claim 10, wherein the punch forms a lower die, the die forms an upper die that is vertically movable towards the lower die, the pre-forming die is mounted on the upper die via an elastic member, the blank holder is mounted on the lower die by a holder driving member, and while the die moves towards the punch after the scrap section has contacted with the bent corner, the elastic member is caused to contract and the movement of the pre-forming die is stopped.

12. The hot-press deep-drawing forming apparatus according to claim 10, wherein the punch forms a lower die, the die forms an upper die that is vertically movable towards the punch, the pre-forming die is mounted on a slide die that is mounted on the die so as to be vertically movable, the blank holder is mounted on the punch by a holder driving member, and while the die moves towards the punch after the scrap section has contacted with the bent corner, the movement of the pre-forming die is stopped by the slide die.

13. The apparatus of claim 10 wherein bent corner is an arcuate bent corner in cross-section.

14. The apparatus of claim 10 wherein there is a spacing gap formed between exterior siding of the die and punch combination and interior siding of the pre-forming die and the blank holder in a region where the scrap section bridges the spacing gap.

15. The apparatus of claim 10 wherein the die and punch are configured such that the scrap section extends so as to be sandwiched between the die and the punch combination.

16. The apparatus of claim 10 wherein the apparatus is configured as to enable a heat removal treatment to a product section of the workpiece with the punch and the die without applying a heat removal treatment to the scrap section.

* * * * *